US005775420A

United States Patent [19]

Mitchell et al.

[11] Patent Number: 5,775,420

[45] Date of Patent: Jul. 7, 1998

[54] DUAL STRING ASSEMBLY FOR GAS WELLS

[76] Inventors: Morton Lindsay Mitchell, 319 Cimmaron Bay, Okotoks, Alberta, Canada, T0L 1T5; Bryson James Mitchell, Box 527, Redcliff, Alberta, Canada, T0J 2P0; Blair Orvel Mitchell, R.R. #2, Site 17, Box 3, Rocky Mountain House, Alberta, Canada, T0M 1T0

[21] Appl. No.: 617,037

[22] Filed: Mar. 18, 1996

[51] Int. Cl.[6] ..... E21B 33/047; E21B 43/14

[52] U.S. Cl. ..... 166/85.4; 166/75.14; 166/89.2; 166/97.5; 166/313

[58] Field of Search ..... 166/54.1, 75.14, 166/85.4, 89.1, 89.2, 97.5, 313

[56] References Cited

U.S. PATENT DOCUMENTS

| | | | |
|---|---|---|---|
| 3,042,427 | 7/1962 | Word, Jr. | 166/89.2 X |
| 3,099,317 | 7/1963 | Todd | 166/89.2 X |
| 3,134,614 | 5/1964 | Brooks | 166/313 X |
| 3,170,518 | 2/1965 | Brown | 166/313 |
| 3,190,354 | 6/1965 | Stone | 166/89.2 X |
| 3,409,084 | 11/1968 | Lawson, Jr. et al. | 166/89.2 X |
| 3,451,481 | 6/1969 | Lanmon, II | 166/89.2 X |
| 4,474,236 | 10/1984 | Kellett | 166/313 X |
| 5,458,199 | 10/1995 | Collins et al. | 166/97.5 X |

*Primary Examiner*—George A. Suchfield

*Attorney, Agent, or Firm*—Murray E. Thrift; Adrian D. Battison

[57] ABSTRACT

A dual completion for gas wells includes a dual base with a primary hanger incorporated in the base. Primary and secondary coiled tubing strings extend through the base at a downwardly converging angle of 2° or less. The dual base is mounted on an annular blowout preventer. At the top of the annular blowout preventer is a tubing centralizer that aligns the two tubing strings parallel to one another. The blowout preventer has two side ports below the bladder allowing the operator to produce gas from the annulus, to flare gas to atmosphere or to pump in kill fluid in the event of an emergency. The alignment of the tubing strings allows production recorders to be run in either string.

12 Claims, 2 Drawing Sheets

DUAL STRING ASSEMBLY FOR GAS WELLS

FIELD OF THE INVENTION

The present invention relates to tools useful in the completion of natural gas wells using dual strings of coiled tubing.

BACKGROUND

Dual string completions are used, for example, in gas wells with a primary string and a secondary string in a single well casing, with the primary string producing from lower perforations in the casing and the secondary string producing from upper perforations in the casing. The dual string completion is less expensive and quicker to install than the more conventional use of a workover rig and workover fluids.

The known tools for dual completions include a dual base mounted on a blowout preventer (BOP). The dual base has a primary string hanger mounted on the top of the base and a secondary string hanger mounted above the primary string hanger and offset angularly from the primary hanger.

The known arrangement limits the size of tubing that can be run in a given size of casing. It is not possible to run a recorder in the secondary string because of the significant bend in the tubing where it passes from the offset hanger into alignment with the casing.

The present invention relates to improvements in dual bases and dual completion systems that ameliorate these problems with the prior art.

SUMMARY

According to one aspect of the present invention there is provided a dual base for running two strings of coiled tubing in a well casing, said dual base comprising a body with a bottom end, a top end and primary and secondary bores for receiving primary and secondary tubing strings respectively, each bore extending through the body from the top towards the bottom with the two bores having axes that converge downwardly at an angle no greater than 2°.

The geometry of the base must be altered significantly from the conventional arrangement to provide the convergence angle of the two strings of no more than 2°. This small angle means that the secondary string bends through an angle of 2° or less and can accommodate a production recorder. At the same time, larger tubing sizes can be used, for example two strings of up to 1.75 inches in diameter in a 4.5 inch casing or a primary string diameter of up to 2.375 inches with a secondary string diameter of up to 1.75 inches in a 5.5 inch casing.

It is preferred that the primary tubing hanger is incorporated into the dual base. This provides for a reduction in the spacing between the two strings at the top of the dual base, so that larger tube sizes can be accommodated and the offset angle can be reduced.

According to another aspect of the present invention, there is provided a dual base system for running two strings of coiled tubing in a well casing, said system comprising a base body having primary and secondary bores for receiving primary and secondary strings of coiled tubing with the primary and secondary bores converging at an angle not more than 2° from the top towards the bottom of the body, a blowout preventer secured to the bottom end of the base body and including a tubing centralizer adjacent an upper end of the blowout preventer for receiving the primary and secondary strings from the primary and secondary bores and aligning the strings substantially parallel to one another.

The tubing centralizer protects the rubber BOP bladder from puncture or damage by the coiled tubing string while it is run into the well bore. It also insures that the secondary string is kept straight so that production recorders can be run in the tubing.

The BOP may be ported below the bladder, preferably with two side ports. This allows the operator to produce gas from the annulus, to flare gas to atmosphere or to pump in kill fluid in an emergency.

BRIEF DESCRIPTION OF THE DRAWINGS

In the accompanying drawings, which illustrate an exemplary embodiments of the present invention.

DETAILED DESCRIPTION

Figure 1:
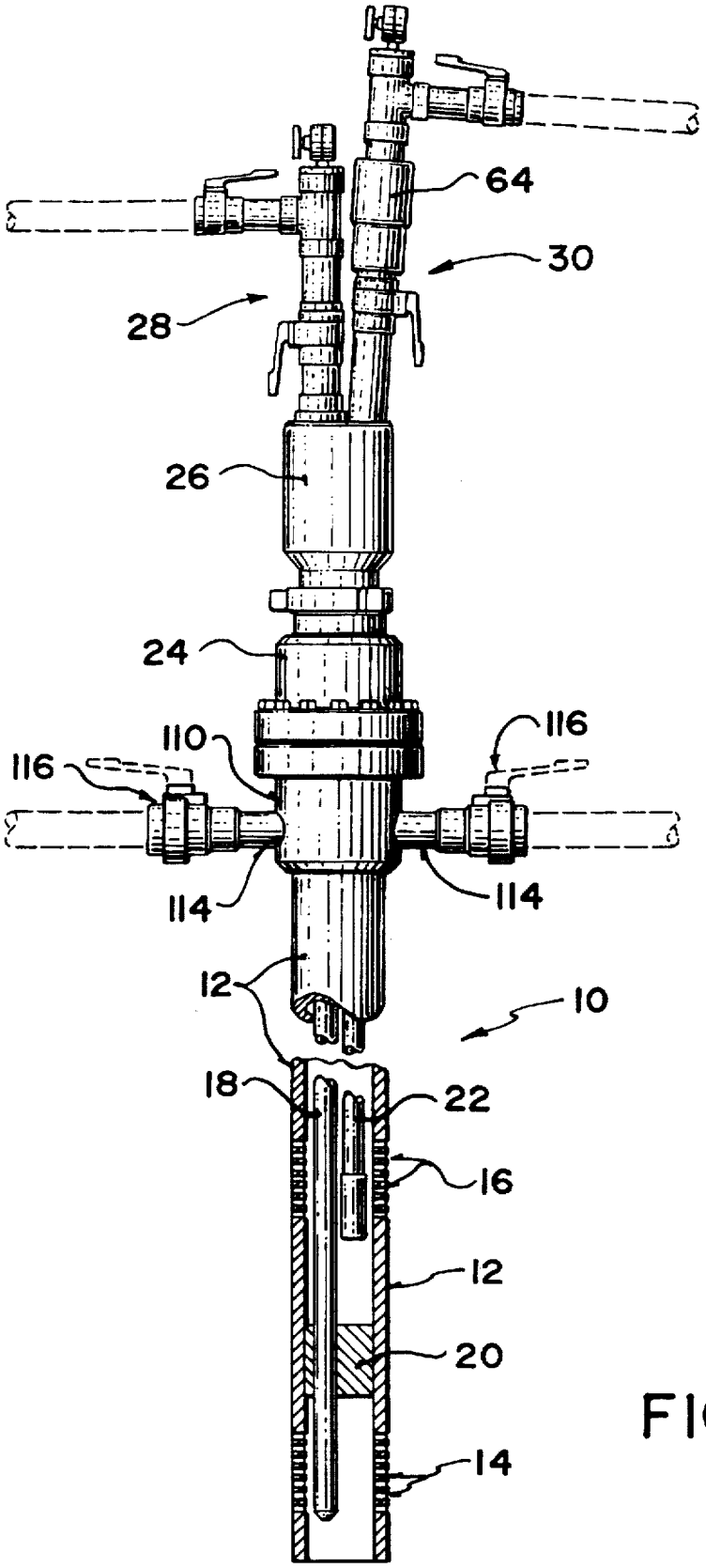
FIG. 1 is an illustration of a dual completion well partially broken away to show internal structure.

Referring to the accompanying drawings, and especially to FIG. 1, there is illustrated a dual string completion gas well. The well has a well casing 12 with lower perforations 14 for admitting gas into a lower portion of the casing and upper perforations 16 for allowing gas to enter an upper portion of the casing. A primary coiled tubing string 18 extends along the well casing from the wellhead to end in the lower part of the casing. A packer 20 seals the primary string against the inside of the casing. A secondary coiled tubing string 22 extends along the casing from the wellhead to a position adjacent the upper perforations 16 and above the packer 20.

At its upper end, the well casing is connected to a blowout preventer (BOP) 24 which supports a dual base 26. The dual base in turn supports a primary stack 28 connected to the primary tubing string 18 and a secondary stack 30 connected to the secondary tubing string 22.

Figure 2:
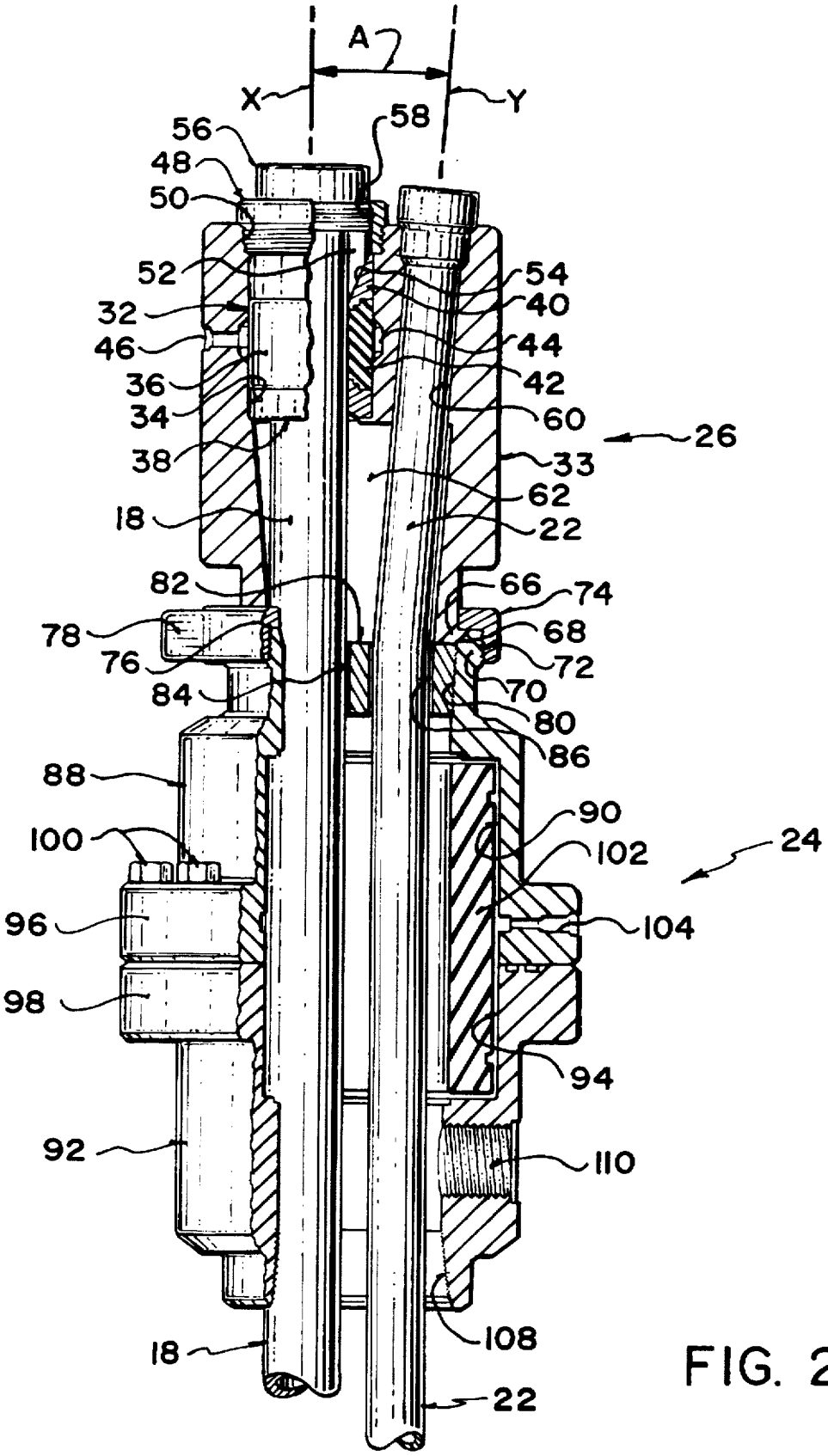
FIG. 2 is an illustration of a dual base and BOP assembly, partially broken away.

As illustrated most particularly in FIG. 2, the primary string is hung from a primary hanger 32 incorporated into the body 33 of the dual base. The primary string bore 34 accommodates a hanger element 36 including a lower cone 38, an upper cone 40 and a sealing element comprising an elastomeric bladder 42 between the two cones. The bladder is surrounded by a fluid chamber 44. Fluid can be injected into the chamber through an injection port 46 to compress the bladder against the primary string 18. An annular retainer 48 is threaded into a threaded counterbore 50 at the outer end of the primary string bore to retain the hanger element 36 in place.

Tubing slips 52 are engaged in the upper end of the hanger element 36. Each slip has a part conical face 54 engaged with the conical face of the upper cone 40. A compression cap 56 is threaded into a bore 58 in the outer end of the retainer 48 and engages the upper ends of the slips 52 to force them down against the upper cone 40 of the hanger element, wedging the slips against the tubing string. The upper end of the compression cap is threaded for connection to a line pipe.

The secondary string bore 60 in the dual base body is arranged beside the primary string bore 34. The axis X of the secondary string bore converges downwardly towards the axis Y of the primary string bore at an angle A of not more than 2°. A cavity 62 is formed in the bottom of the dual base.

The secondary stack 30 above the dual base includes a secondary string hanger 64 (FIG. 1) spaced above the base and offset from the primary string stack.

At the bottom of the dual base body is a peripheral flange 66 with an outer conical face 68. This engages a matching conical face 70 on the top of BOP 24. The dual base is coupled to the BOP using a hammer union. The coupling includes an external thread 72 on the BOP, a union nut 74 engaged with the thread 72 and a split ring 76 engaged between the top of the flange 66 on the base and the union nut. The union nut has circumferentially spaced hammering lugs 78.

The top end of the BOP also has a tapered internal thread 80. A tubing centralizer 82 is screwed into this thread. The centralizer has parallel bores 84 and 86 for accommodating the primary and secondary tubing strings respectively. This brings the secondary string into parallel alignment with the primary string and ensures that the BOP bladder is not damaged as the coiled tubing string is run into the well bore.

The BOP has an upper section 88 with an internal cavity 90 and a lower section 92 with an internal cavity 94. The two sections have mating flanges 96 and 98 respectively that are coupled using bolts 100, with the cavities 90 and 94 aligned to provide a single cavity accommodating the BOP bladder 102. The bladder is inflated with hydraulic fluid injected through an injection port 104. The bottom of the BOP has an internal thread 108 for engagement with the upper end of the well casing.

Below the cavity 94 and above the thread 108, the BOP has two side ports 110 (one shown). These communicate with the annulus around the two tubing strings. These ports allow the operator to produce gas from the annulus, to flare gas to atmosphere or to pump in kill fluid in the event of an emergency. In the complete well, each of the ports is connected to a nipple 114 which is in turn coupled to a ball valve 116 (FIG. 1).

The dual completion allows the completion of a gas well more quickly and at reduced cost compared to the use of a workover rig and workover fluid. The dual base configuration allows the use of larger diameter coiled tubing in a given size of production tubing. It also allows the use of production recorders inside the tubing of both the primary and secondary strings.

While a particular embodiment of the present invention has been described in the foregoing, it is to be understood that other embodiments are possible within the scope of the invention. It is in particular possible to construct embodiments of the invention that accommodate a larger primary string than the secondary string. Various fittings, for example flanged couplings, may be used in place of threaded fittings to mate with the casing or any other elements as required. All such modifications and variations are intended to be included within the scope of the appended claims.

We claim:

1. A dual base for running two strings of coiled tubing in a well casing, said dual base comprising a body with a bottom end, a top end and primary and secondary bores for receiving primary and secondary tubing strings respectively, each bore extending through the body from the top towards the bottom with the two bores having axes that converge downwardly at an angle greater than 0° and no greater than 2°.

2. A dual base according to claim 1 including a primary string hanger recessed into the body at the primary bore.

3. A dual base according to claim 2 wherein the hanger comprises a hanger bore in the top end of the body, a counter bore at the top end of the hanger bore, a sealing element in the bore and an annular retainer in the counter bore for retaining the sealing element in the hanger bore.

4. A dual base system for running two strings of coiled tubing in a well casing, said system comprising a base body having primary and secondary bores for receiving primary and secondary strings of coiled tubing, with the primary and secondary bores converging at an angle not more than 2° from the top towards the bottom of the body, a blowout preventer secured to the bottom end of the base body and including a tubing centralizer adjacent an upper end of the blowout preventer for receiving the primary and secondary strings from the primary and secondary bores and aligning the strings substantially parallel to one another.

5. A system according to claim 4 wherein the blowout preventer comprises a chamber below the tubing centralizer, a bladder in the chamber for receiving the primary and secondary strings therethrough, means for inflating the bladder into sealing engagement with the chamber and the primary and secondary strings.

6. A system according to claim 5 wherein the blowout preventer comprises at least one port communicating with the annulus around the tubing strings below the bladder.

7. A system according to claim 6 wherein the blowout preventer comprises two ports communicating with the annulus.

8. A system according to claim 4 wherein the blowout preventer comprises an external thread at an upper thereof, an internal tapered thread at the upper end thereof and the system includes a union nut and split ring coupling the dual base to the external thread, the tubing centralizer being threaded into the internal tapered thread at the upper end of the blowout preventer.

9. A dual base according to claim 3 wherein the sealing element comprises a bladder and means for compressing the bladder against the primary string.

10. A dual base according to claim 9 wherein the means for compressing the bladder against the primary string include a fluid chamber around the bladder.

11. A dual base according to claim 10 including tubing slips in the hanger bore and means for engaging the slips with the primary string.

12. A dual base according to claim 11 wherein the hanger further comprises an upper cone at an upper end of the bladder and the tubing slips are engaged with the upper cone, and including a compression cap engaged in the hanger bore and forcing the tubing slips down against the upper cone.

* * * * *